United States Patent [19]

Waldo et al.

[11] 4,438,544

[45] Mar. 27, 1984

[54] LOOPED ROD SAFETY STOP

[75] Inventors: Russell W. Waldo, Mendota Heights, Minn.; Cardel E. Miller, Hudson, Wis.

[73] Assignee: Ideal Security Hardware Corporation, Saint Paul, Minn.

[21] Appl. No.: 338,169

[22] Filed: Jan. 8, 1982

[51] Int. Cl.[3] ..... E05F 5/08

[52] U.S. Cl. ..... 16/85; 16/65; 16/72; 16/DIG. 36

[58] Field of Search ..... 16/49, 65, 72, 75, 76, 16/80, 82, 85, DIG. 36

[56] References Cited

U.S. PATENT DOCUMENTS

| | | | |
|---|---|---|---|
| 832,603 | 10/1906 | Fritts . | |
| 1,258,451 | 3/1918 | Pezdir | 16/80 |
| 1,836,013 | 12/1931 | Carlson . | |
| 2,753,587 | 7/1956 | Quinn | 16/66 |
| 2,822,567 | 2/1958 | McCreary | 16/35 |
| 2,969,560 | 1/1961 | Pierie | 16/49 |

*Primary Examiner*—Fred A. Silverberg

*Attorney, Agent, or Firm*—Merchant & Gould

[57] ABSTRACT

The invention of the present application is a guard for limiting the opening of a door (10) with respect to the frame (12) in which it is mounted. The device includes first and second wire forms (14, 42), each having a looped extension portion (38, 46) formed in ends thereof. The looped extensions (38, 46) have apertures (40, 50) defined thereby, which apertures (40, 50) are significantly larger than dimensions of portions (36) of forms (14, 42) received within the apertures (40, 50). A compression spring (52) is disposed intermediate the looped extensions (38, 46) with coils (54, 54', 56) of the spring (52) encircling portions of the forms (14, 42) intermediate the extensions (38, 46).

4 Claims, 7 Drawing Figures

LOOPED ROD SAFETY STOP

TECHNICAL FIELD

The invention of the present application is broadly related to the field of doors and door closure apparatus. More narrowly, the invention is directed to a device for checking the swinging open of a door, such as a storm door, beyond a point which defines the maximum amount to which the door is desired to be opened. A specific structure of the invention precludes opening of the door beyond the point defining the maximum amount of opening, but yet precludes a sudden stopping of the door in order to avert possible injury to a person passing through the frame in which the door is mounted.

BACKGROUND OF THE INVENTION

Doors, usually referred to as storm or screen doors, are typically light in weight and lend themselves to being opened rather rapidly. When a person passes through the frame in which the door is mounted, and particularly when the person is in a hurry, the tendency is for the storm or screen door to be opened quickly and to a point where it swings wide to engage a wall structure in which the frame of the door is mounted.

Opening of the door to such an extent is, however, unnecessary to the passage of the person through the frame and, frequently, damaging of the door or the wall structure, and even hazardous to either the person opening the door or other people in the vicinity. Consequently, various door guard and check devices have been constructed in order to limit the unrestricted swinging of the door. As the door is swung open to positions beyond one in which it is at a substantially right angle to the door frame, the guard functions to both attenuate the swinging open of the door and to urge the door back to a closed position.

One structure which accomplishes such a function is illustrated in U.S. Pat. No. 2,969,560 issued to C. G. Pierie on Jan. 31, 1961 for a DOOR RETURN AND CHECK MECHANISM. The mechanism of that patent includes a compression spring disposed intermediate a pair of end plates, which spring is compressed as the end plates attach to a pair of co-acting yokes moved toward one another. Each of the end plates has a pair of openings provided therein for allowing the passage of legs of the opposite yoke through the plate. Each of the openings is sized similar to the cross-sectional size of the leg of the yoke which passes through the opening. As the yokes move relative to one another in a telescoping fashion as the door is opened and closed, the chance exists, therefore, that if the legs of the yokes flex because of pressure exerted thereon, they will bind in the openings and preclude free swinging movement of the door prior to when it achieves a position at which restriction is desired.

Another potential problem which exists with door check systems of this nature is one wherein a compression spring will engage the door during opening and closing thereof because of its close proximity thereto. Because of the relative axial movement of one coil of the compression spring with respect to another, chafing of the door structure as it is engaged by the compression spring might occur.

The invention of the present application is an improved door check device which solves these problems. It provides a structure which significantly reduces the possibility of binding as the door is urged open and, therefore, one which will allow the door to be freely opened to a position at which the check will attenuate open movement. Additionally, it functions to restrict the possibility of chafing of the door by the compression spring.

SUMMARY OF THE INVENTION

The invention of the present application is an apparatus for checking the unrestricted opening of a door which is hingedly mounted in a frame for movement between positions wherein it is closed within the frame and wherein it is swung outwardly from the frame. The apparatus includes a first structural element which is mounted to the door. The element is elongated, from its point of attachment, along an axis, and has, spaced from the end at which it is mounted, a member having an aperture formed therethrough. A second element is mounted to the frame and extends therefrom along an axis of elongation and in a direction generally opposite to the direction in which the first element extends. As with the first element, the second element carries, at a location spaced from the end by which it is mounted a member having an aperture formed therein. The elements extend through the apertures formed in the members which are carried by the opposite of the elements, and the apertures are sized significantly larger than the elements extending therethrough in order to facilitate free sliding of one element through the aperture in which it is received. Compression means are disposed intermediate the members carried by the elements so that, as the members approach one another during opening of the door, the means will compress and function to urge the members outwardly away from one another. It is necessary, therefore, that the compression means include a pair of shoulders, each axially engaging one of the members.

In a preferred embodiment, the apparatus can be such that each of the elements comprises a generally linearly extending wire form having a looped portion, integrally formed with its respective generally linearly extending portion, at the end of the form opposite the end by which it is attached to its respective door or frame structure. Similarly, the compression means can comprise a wire spring formed from stock similar in gauge to that from which the wire form elements are formed.

The looped extensions of the wire forms can be such that they define planes oblique to one another. The wire forms can be disposed so that the loops define planes wherein, when the loops engage axial end coils of the spring, the spring will be compressed in a fashion so that the coils thereof are urged away from the door. The likelihood of chafing of the door is, thereby, reduced.

The invention of the present application is, thus, an improved door check mechanism. More specific features and advantages thereby obtained will become apparent with reference to the detailed description of the invention, claims, and appended drawings.

DETAILED DESCRIPTION OF THE INVENTION

Figures 1, 2, 3, 4, 5, 6, 7:
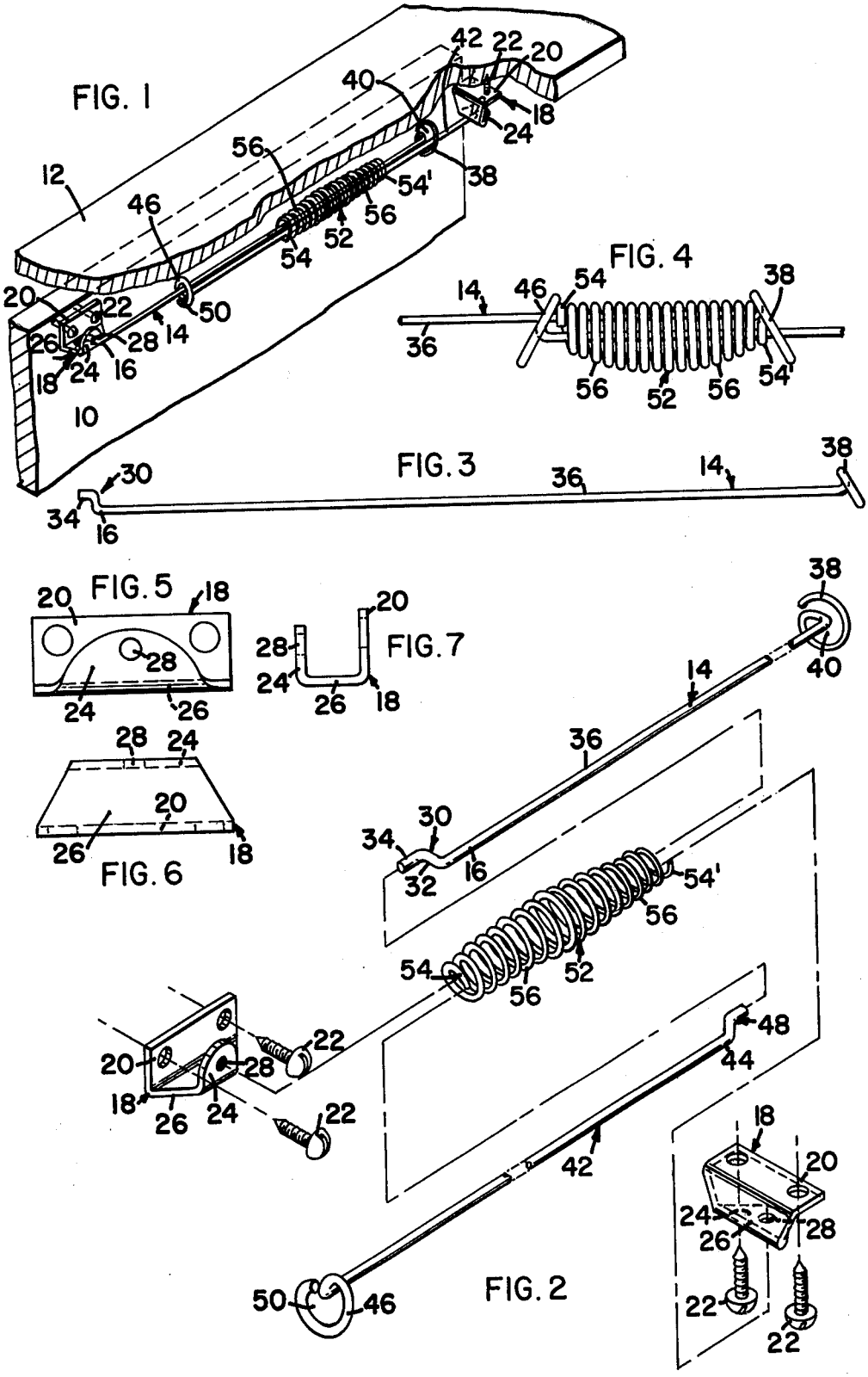
FIG. 1 is a perspective view illustrating the manner in which the invention of the present application is mounted to a door and a frame to which the door is hingedly mounted, some portions thereof being broken away to illustrate the relative cooperation of the parts.
FIG. 2 is an exploded view of the door check mechanism.
FIG. 3 is an elevational view of one of the formed wire elements.
FIG. 4 is an elevational view illustrating the manner in which the elements urge the compression spring away from the door.
FIG. 5 is a front elevational view of a universal bracket by which the wire forms can be mounted to the door and the frame.
FIG. 6 is a bottom plan view of the bracket of FIG. 5.
FIG. 7 is an end view of the bracket of FIG. 5.

Referring now the drawing wherein like reference numerals denote like elements throughout the several views, FIG. 1 illustrates a door 10 mounted for opening and closing about a hinge (not shown). The door 10 is hingedly mounted within a frame 12 supported in a wall structure (not shown).

A first wire form 14 is secured at a mounting end 16 thereof to the door by appropriate means. A universal bracket 18, as best seen in FIGS. 5 through 7, can be used for this purpose. The bracket 18 includes a mounting flange 20 which is secured to the door 10 by appropriate means such as screws 22.

The bracket 18 includes a platen portion 24 which defines a plane generally parallel to a plane defined by mounting flange 20. Platen portion 24 and the mounting flange 20 are interconnected by member 26 so that the bracket 18 appears generally u-shaped in side elevation as seen in FIG. 7.

The platen portion 24 has an aperture 28 formed therethrough. The aperture is sized similar to the diameter of the wire form 14 so that the mounting end 16 of the wire form 14 can be received in the aperture 28 with a small clearance.

The mounting end 16 of wire form 14 is dog-legged as at 30 in order to define a portion 32 of the form 14 which is generally perpendicular to the longitudinal axis thereof. This portion 32 is the portion which is actually received in the aperture 28, and portions 34, 36 of form 14 straddling portion 32 preclude withdrawal of form 14 from the aperture 28 as long as perpendicular portion 32 extends generally normal to the plane defined by platen portion 24 of bracket 18.

Portion 36 of the wire form 14 has, formed in an end remote from the mounting end 16 thereof an enlargement. Typically, this enlargement would be a looped extension 38 of the form 14 formed integrally therewith. It will be understood, however, that the enlargement need not be formed integrally with the remainder of the formed wire rod 14. The enlargement does, however, define an aperture 40 within its bounds.

A second wire form 42 is mounted by its mounting end 44 to the door frame 12. Wire form 42 is shown as being similar in structure to the first wire form 14, having a looped extension 46 formed at an end opposite its mounting end 44. Similarly, the second formed wire rod 42 can have a dog-legged portion 48 at its mounting end in order to accomplish affixation of the rod 42 to the door frame 12. Again, as in the case of the first rod 14, a bracket, such as universal bracket 18 can be used in conjunction with the dog-legged portion 48 of rod 42 to complete the mounting.

Also as in the case of the first rod 14, the looped extension 46 of the second rod 42 defines an aperture 50 therewithin. Aperture 50 is significantly larger than the dimensions of rod 14 taken in a plane generally transverse to the longitudinal axis of the rod 14. Similarly, aperture 40 is significantly larger than the dimensions of rod 42 taken in a plane generally transverse to its longitudinal axis. Consequently, rod 14 will slide freely through aperture 50 when received therein, and rod 42 will slide freely through aperture 40 when received therein. As seen in FIGS. 1, 2, and 4, the rods 14, 42 are assembled in this manner so that they move relative to one another axially in a telescoping fashion as door 10 is opened and closed within frame 12.

A compression spring 52 is interposed between the looped extensions 38, 46. The spring has a pair of end coils 54, 54' and a plurality of intermediate coils 56. End coils 54, 54' are sufficiently large to preclude their passing through the apertures 40, 50. Coils 54, 54', thereby, define shoulders which engage the looped extensions 38, 46.

It will be understood that, when the door is closed, looped extensions 38, 46 may be spaced sufficiently far apart so that both end coils 54, 54' need not be engaged by the extensions 38, 46. As the door 10 is opened, however, extension 38 will approach extension 46 until both end coils 54, 54' are engaged. At this point, the spring 52 will compress as the door is opened further. The length of spring 52 and the distance between the looped extension 38, 46 will be made so that checking of the door 10 will occur only when it is opened to a point at which further opening is desired to be precluded.

As best seen in FIG. 4, the looped extensions 38, 46 can be formed in ends of the rods 14, 42 respectively, remote from the ends 16, 44 of mounting so that they define planes oblique with respect to the longitudinal axes of the rods 14, 42. The looped extensions 38, 46 can be formed so that, as they engage the end coils 54, 54', they will exert upon the spring 52 forces having components both along the longitudinal axis about which the spring 52 is coiled and in a direction perpendicular to that axis. The extensions 38, 46 are structured in each rod 14, 42 so that the planes defined by the extensions 38, 46 are oblique to one another. With such a structuring of the rods 14, 42, the spring 52 can be urged in a direction away from the door 10 in order to preclude abrasion and chafing of the door 10.

In one embodiment of the invention, it has been found appropriate to structure the looped extensions 38, 46 wherein they form angles of approximately 60° with respect to their respective rods 14, 42. By so forming the extensions with respect to their respective rods, an angle of 60° can be defined between the planes of the extensions.

Numerous characteristics of the invention have been set forth in the foregoing description. It will be understood, of course, that this disclosure is, in many respects, only illustrative. Changes may be made in details, particularly in matters of shape, size and arrangement of parts without exceeding the scope of the invention. The invention's scope is defined in the language by which the appended claims are expressed.

What is claimed is:

1. Apparatus for checking the unrestricted opening of a door hingedly mounted in a frame, comprising:

(a) a first elongated element having one end thereof mounted at the door and carrying, spaced from said mounted end, a member having an aperture formed therethrough;

(b) a second elongated element having one end thereof mounted at the frame and carrying, spaced from said mounted end, a member having an aperture formed therethrough;

(c) wherein said aperture in said member carried by said first element is significantly larger than dimensions of said second element in a plane normal to an axis of elongation of said second element, and said aperture in said member carried by said second element is significantly larger than dimensions of said first element in a plane normal to an axis of elongation of said first element;

(d) wherein said first element is received in said aperture in said member carried by said second element and said second element is received in said aperture in said member carried by said first element for relative axial movement of said first element and said second element;

(e) wherein said first element and said second element comprise generally linearly extending wire forms, and wherein said member of said first element and said member of said second element comprise looped extensions of said first element and said second element integrally formed therewith at ends of said first element and said second element opposite said ends by which said first element and said second element are mounted to the door and frame respectively; and and (f) a wire spring enclosing said first element and said second element intermediate said member of said first element and said member of said second element and having a pair of shoulders, each axially engaging one of said member of said first element and said member of said second element, said wire spring having opposite axial end coils, and wherein each of said coils is sufficiently large wherein it cannot pass through a corresponding aperture defined by one of said looped extensions, said wire spring includes a plurality of intermediate coils and wherein said looped extensions define planes angled relative to one another so that as said looped extensions engage said end coils and compress said spring, said coils are urged away from the door.

2. Apparatus in accordance with claim 1 wherein an angle formed between said defined planes is approximately 60°.

3. A guard for arresting and attenuating the swinging open of a door hingedly mounted in a frame, comprising:

(a) a first generally linearly extending rod having opposite ends, being pivotally mounted at one of said ends to the door, and having a loop defining an aperture significantly larger than dimensions of said rod in a plane orthogonal to a longitudinal axis of said rod, formed in an opposite of said ends;

(b) a second rod, shaped and dimensioned similar to said first rod, having opposite ends, being pivotally mounted at one of said ends to the frame, and having a loop defining an aperture significantly larger than dimensions of said second rod in a plane orthogonal to a longitudinal axis of said second rod, formed in an opposite of said ends;

(c) wherein said first rod is disposed for axial movement relative to said second rod and through said loop formed in said end of said second rod opposite said end at which said second rod is mounted to the frame, and wherein said second rod is disposed for movement through said loop formed in said end of said first rod opposite said end at which said first rod is mounted to the door, whereby said first rod and said second rod telescope as the door is opened and closed;

(d) a multi-coiled compression spring having coils encircling both of said first rod and said second rod intermediate said loop of said first rod and said loop of said second rod, and opposite axial end coils, each engaging one of said loop of said first rod and said loop of said second rod; and (e) wherein said loop of said first rod and said loop of said second rod define planes oblique to the longitudinal axes of respective rods.

4. A guard in accordance with claim 3 wherein each of said loop of said first rod and said loop of said second rod defines a plane forming an angle of approximately 60° with its respective rod.

* * * * *